US007922069B2

(12) United States Patent
Gardner

(10) Patent No.: US 7,922,069 B2
(45) Date of Patent: Apr. 12, 2011

(54) REINFORCED CONTAINER

(75) Inventor: Jeffrey M Gardner, W Chicago, IL (US)

(73) Assignee: International Paper Co., Memphis, TN (US)

( * ) Notice: Subject to any disclaimer, the term of this patent is extended or adjusted under 35 U.S.C. 154(b) by 191 days.

(21) Appl. No.: 12/168,741

(22) Filed: Jul. 7, 2008

(65) Prior Publication Data

US 2010/0001052 A1 Jan. 7, 2010

(51) Int. Cl.
*B65D 5/42* (2006.01)
*B65D 5/28* (2006.01)
*B65D 5/20* (2006.01)

(52) U.S. Cl. ..... 229/109; 229/143; 229/198; 229/199

(58) Field of Classification Search ..... 229/109, 229/143, 919, 185.1
See application file for complete search history.

(56) References Cited

U.S. PATENT DOCUMENTS

| | | | | |
|---|---|---|---|---|
| 4,607,750 | A * | 8/1986 | Valenti | 206/443 |
| 4,676,429 | A | 6/1987 | Crowe et al. | |
| 5,372,299 | A * | 12/1994 | Edgerton et al. | 229/120.18 |
| 5,673,848 | A * | 10/1997 | Garza | 229/191 |
| 5,950,911 | A * | 9/1999 | Naughton et al. | 229/109 |
| 2003/0038051 | A1 * | 2/2003 | Bennett et al. | 206/509 |
| 2006/0138205 | A1 * | 6/2006 | Keefe et al. | 229/179 |

OTHER PUBLICATIONS

Structural-Calc LLC, LatPro IRC 2003; http://lateralpro.com/latproIBC2003_v2_Info.htm.

* cited by examiner

*Primary Examiner* — Nathan J Newhouse
*Assistant Examiner* — Christopher DeMeree

(57) ABSTRACT

A container having interior columns on its end walls which are between the sides of the end walls. Each column is formed by a first column panel attached to an inner end panel, a second column panel attached to the first column panel and an attachment panel fastened to the inner end panel. A blank for the container.

3 Claims, 10 Drawing Sheets

REINFORCED CONTAINER

This invention relates to a container with interior columns.

DETAILED DESCRIPTION

Throughout the application the attachment lines may be score lines, reverse score lines or cut and score lines depending on the use of the particular attachment line. In this application the predominant attachment line will be a score line.

Figure 1:
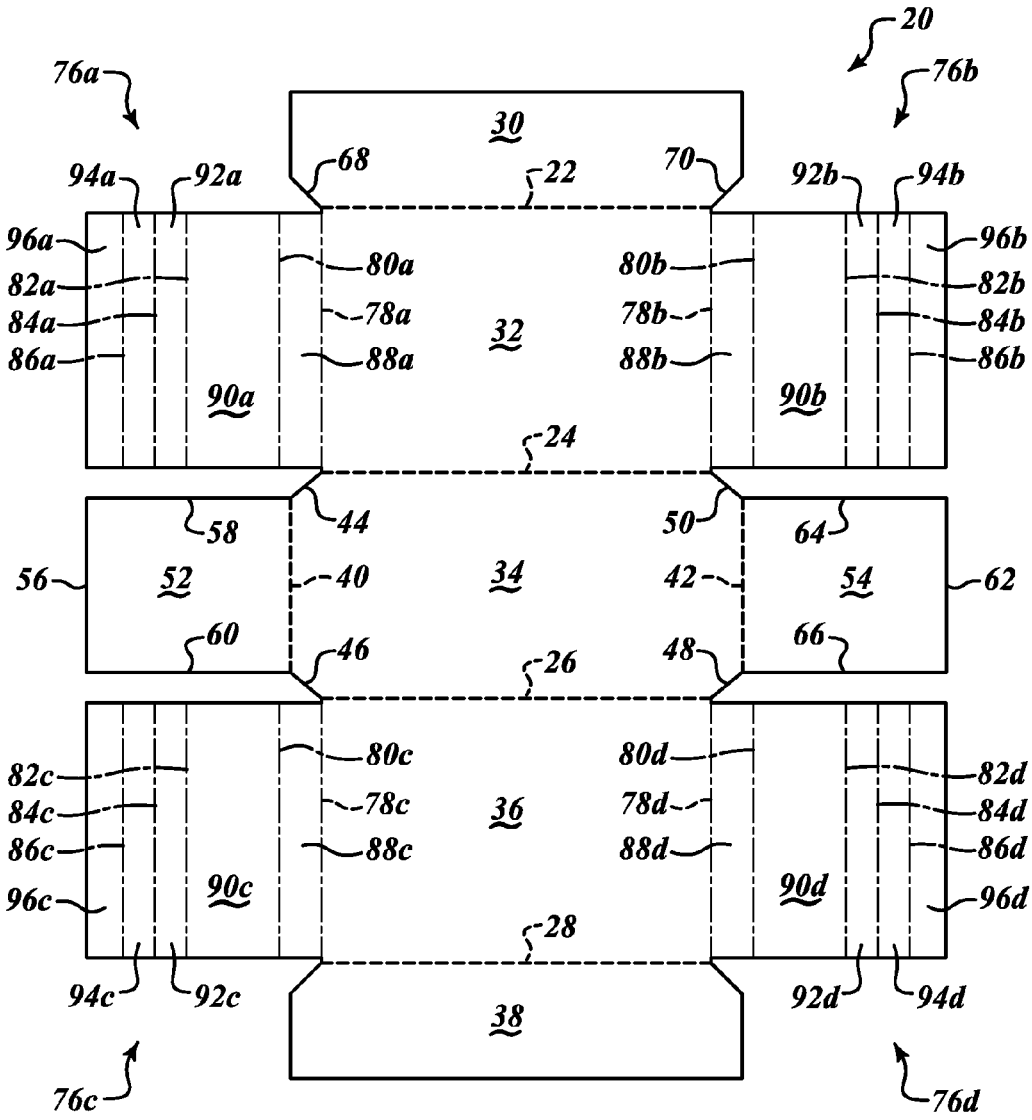
FIG. 1 is a top plan view of a blank for a container that is octagonal in cross-section.
Figure 2:
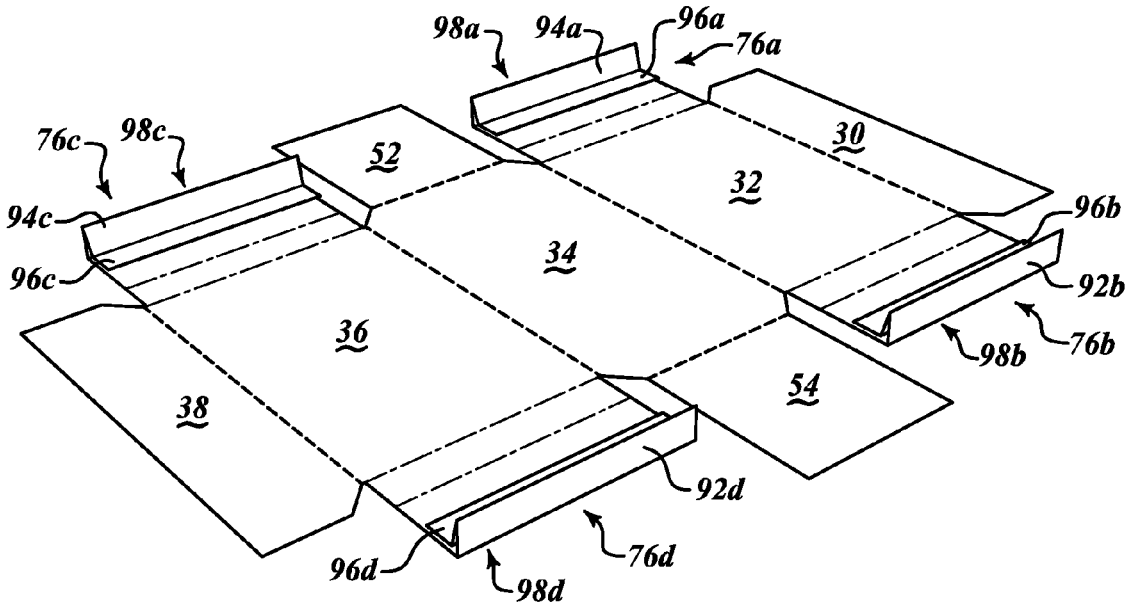
FIG. 2-7 are isometric views showing the formation of the container.
Figure 3:
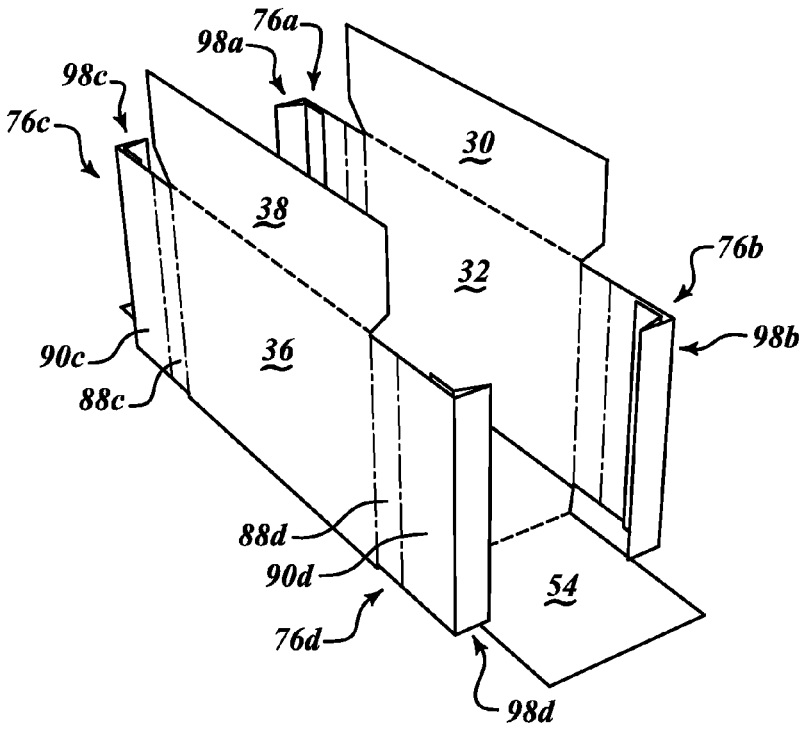
Figure 4:
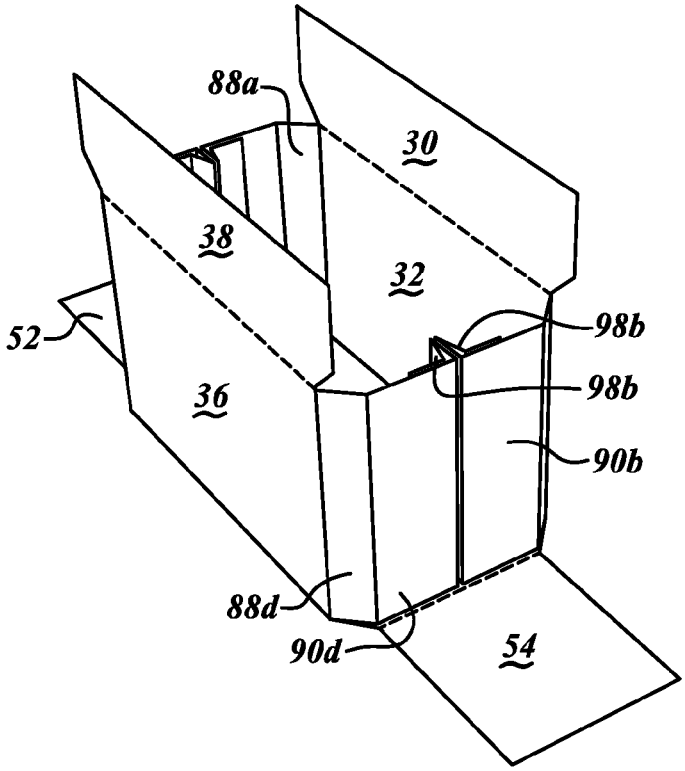
Figure 5:
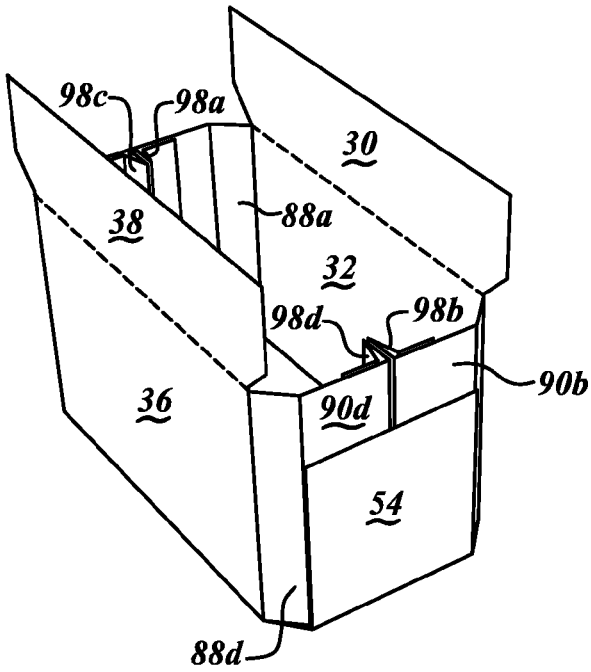

FIG. 1 shows a blank for a container that is octagonal in cross-section. In FIG. 1 the blank 20 is divided by longitudinal parallel attachment lines 22, 24, 26 and 28 into a cover panel 30, a side panel 32, a bottom panel 34, a side panel 36 and a cover panel 38. The bottom panel 34 is octagonal in cross section with sides formed by attachment lines 24 and 26, ends formed by transverse parallel attachment lines 40 and 42 and beveled corners 44, 46, 48 and 50 extending between the attachment lines 24, 40, 26 and 42. The width of each of these corners between the attachment lines is the same.

End panels 52 and 54 are attached to bottom panel 34 along the transverse parallel attachment lines 40 and 42. End panel 52 has an outer edge 56 and side edges 58 and 60. End panel 54 has an outer edge 62 and side edges 64 and 66. The height of each of the end panels 52 and 54 is the distance between its attachment line 40 or 42 and its outer edge 56 or 62. The width of each of the end panels 52 or 54 is the distance between its side edges 58 and 60 or 64 and 66.

Each of the cover panels 30 and 38 is shaped to form a cover that has the same shape as the bottom panel in the formed container. Cover panel 30 has a pair of beveled corners 68 and 70 and cover panel 38 has a pair of beveled corners 72 and 74. The width of each of these corners is the same as the width of the corners in the bottom panel.

The end walls in the formed container are formed by the end panels 52 and 54 and by end members attached to the side panels. Each of these end members has the same design so the same reference numerals will be used for each of them. End members 76*a* and 76*b* are attached to the sides of side panel 32. End members 76*c* and 76*d* are attached to the sides of side panel 36. Each of the end members 76 is attached to the side panel by a transverse attachment line 78. Each of the end members 76 is divided by transverse attachment lines 80, 82, 84 and 86 into corner panel 88, end panel 90, column panel 92, column panel 94 and attachment panel 96. The width of each of the corner panels 88 between attachment lines 78 and 80 is the same as the width of one of the corners 44, 46, 48 and 50. The combined width of two of the end panels 90 between attachment lines 80 and 82 is the same or less than the width of one of the end panels 52 and 54.

The columns are formed on the inside face of the end panels 90. The columns are formed by folding attachment panel 96 outwardly around attachment line 86, folding column panel 94 inwardly around attachment line 84 and folding column panel 92 inwardly around attachment line 82. The attachment panel 96 is fastened to end panel 90 by glue or staples. This forms the column 98.

Figure 6:
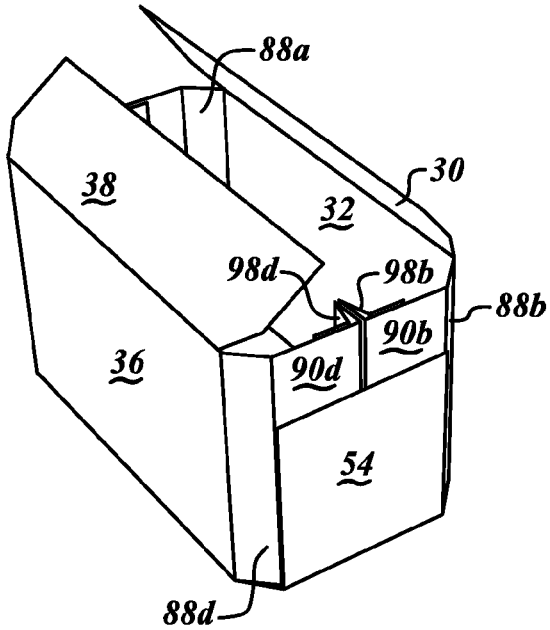
Figure 7:
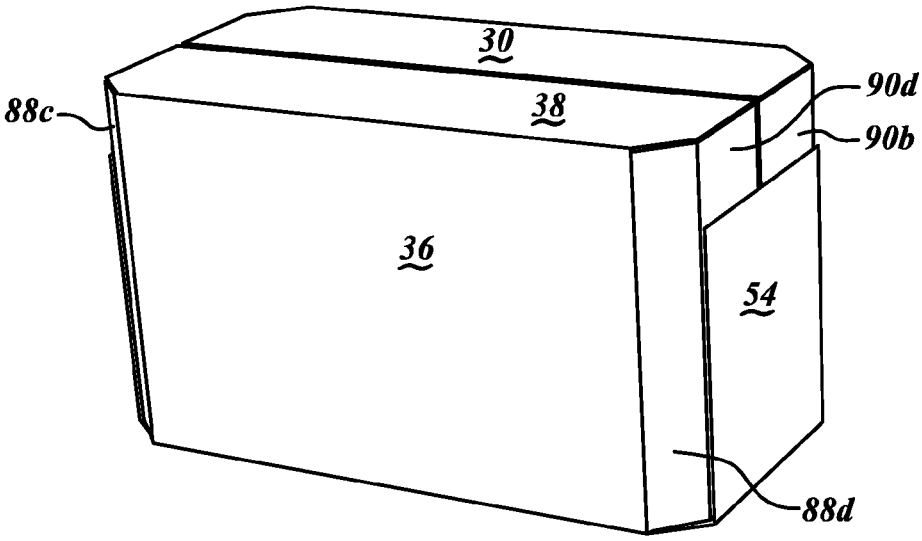

The container is formed by folding the side panels 32 and 35 upwardly around attachment lines 24 and 26 until the side panels are perpendicular to the bottom panel 34. The end members 76 are folded inwardly around attachment lines 78 and the end panels 90 are folded inwardly around attachment lines 80. The corner panels are aligned with their respective corners and the end panels 90 are aligned with their respective ends. The panels 92 of adjoining columns 98 butt together and can be glued together. The end panels 52 and 54 are folded upwardly around attachment lines 40 and 42. Each of the end panels 52 and 54 is fastened to a pair of end panels 90 by glue or staples. The formed container is shown in FIGS. 6 and 7.

Figure 8:
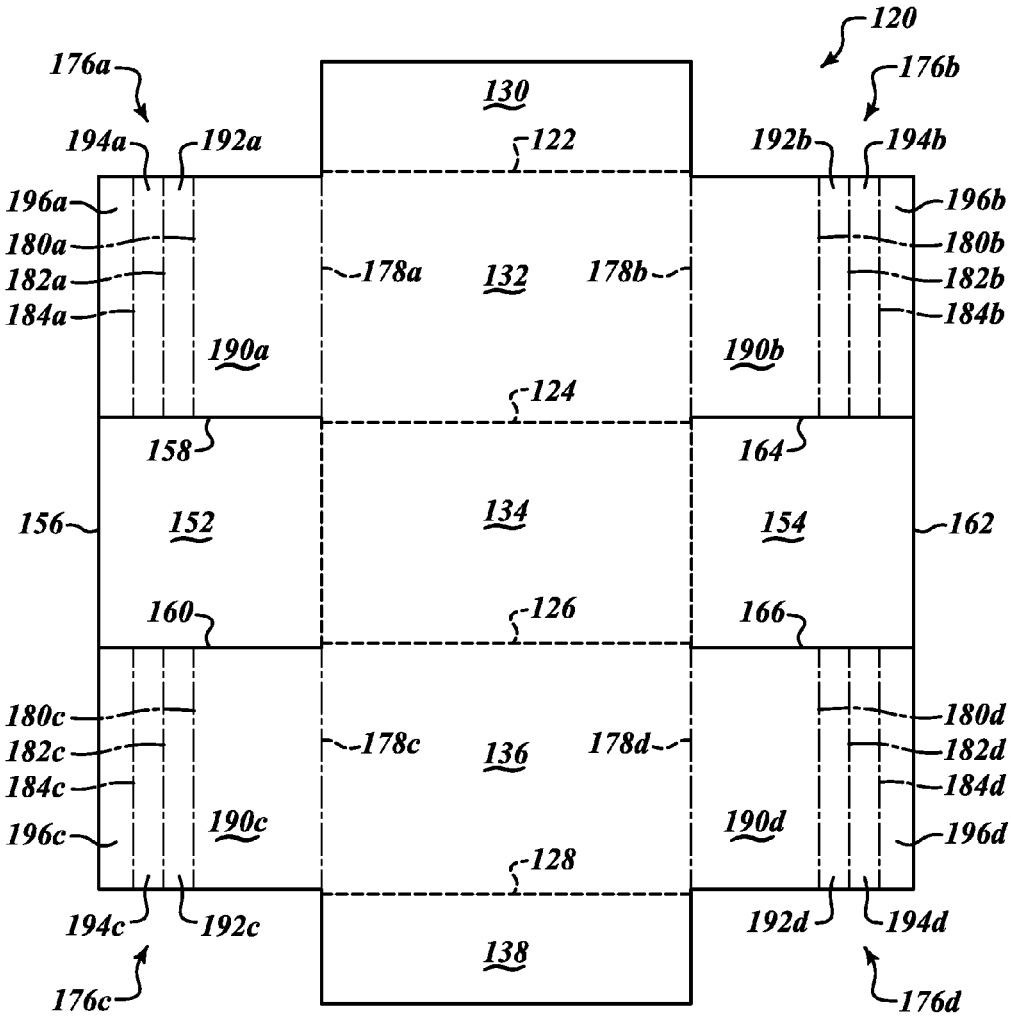
FIG. 8 is a top plan view of a blank for a container that is rectangular in cross-section.

FIG. 8 shows a blank for a container that is rectangular in cross-section. The formation of the rectangular container is the same as the formation of the octagonal container.

In FIG. 8 the blank 120 is divided by longitudinal parallel attachment lines 122, 124, 126 and 128 into a cover panel 130, a side panel 132, a bottom panel 134, a side panel 136 and a cover panel 138. The bottom panel 134 is rectangular in cross section with sides formed by attachment lines 124 and 126 and ends formed by transverse parallel attachment lines 140 and 142.

End panels 152 and 154 are attached to bottom panel 134 along the transverse parallel attachment lines 140 and 142. End panel 152 has an outer edge 156 and side edges 158 and 160. End panel 154 has an outer edge 162 and side edges 164 and 166. The height of each of the end panels 152 and 154 is the distance between its attachment line 140 or 142 and its outer edge 156 or 162. The width of each of the end panels 152 or 154 is the distance between its side edges 158 and 160 or 164 and 166.

Each of the cover panels 130 and 138 is shaped to form a cover that has the same shape as the bottom panel in the formed container.

The end walls in the formed container are formed by the end panels 152 and 154 and by end members attached to the side panels. Each of these end members has the same design so the same reference numerals will be used for each of them. End members 176*a* and 176*b* are attached to the sides of side panel 132. End members 176*c* and 176*d* are attached to the sides of side panel 136. Each of the end members 176 is attached to the side panel by a transverse attachment line 178. The transverse attachment lines on each side of the side panel are parallel. Each of the end members 176 is divided by parallel transverse attachment lines 180, 182 and 184 into end panel 190, column panel 192, column panel 194 and attachment panel 196. The combined width of two of the end panels 190 between attachment lines 178 and 180 is the same or less than the width of one of the end panels 152 and 154.

The columns are formed on the inside face of the end panels 190. The columns are formed by folding attachment panel 196 outwardly around attachment line 184, folding column panel 194 inwardly around attachment line 182 and folding column panel 192 inwardly around attachment line 180. The attachment panel 196 is fastened to end panel 190 by glue or staples. This forms the column 198.

Figure 9:
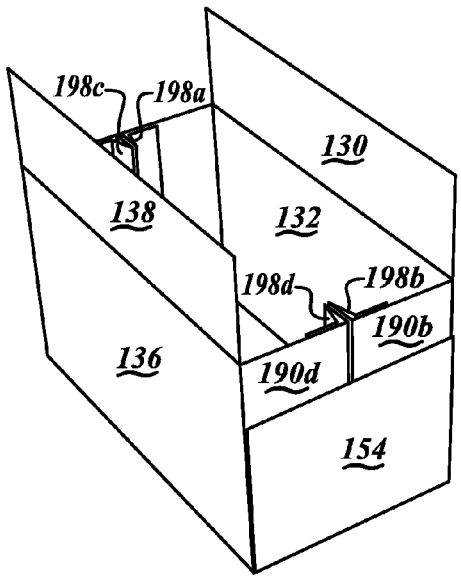
FIG. 9 is an isometric view of the formed rectangular container.

The container is formed by folding the side panels 132 and 135 upwardly around attachment lines 124 and 126 until the side panels are perpendicular to the bottom panel 134. The end panels 190 are folded inwardly around attachment lines 178 and are aligned with their respective ends. The panels 192 of adjoining columns 198 butt together and can be glued together. The end panels 152 and 154 are folded upwardly around attachment lines 140 and 142. Each of the end panels 152 and 154 is fastened to a pair of end panels 190 by glue or staples. The formed container is shown in FIG. 9.

The following embodiments have only one column at each end of the container.

Figure 10:
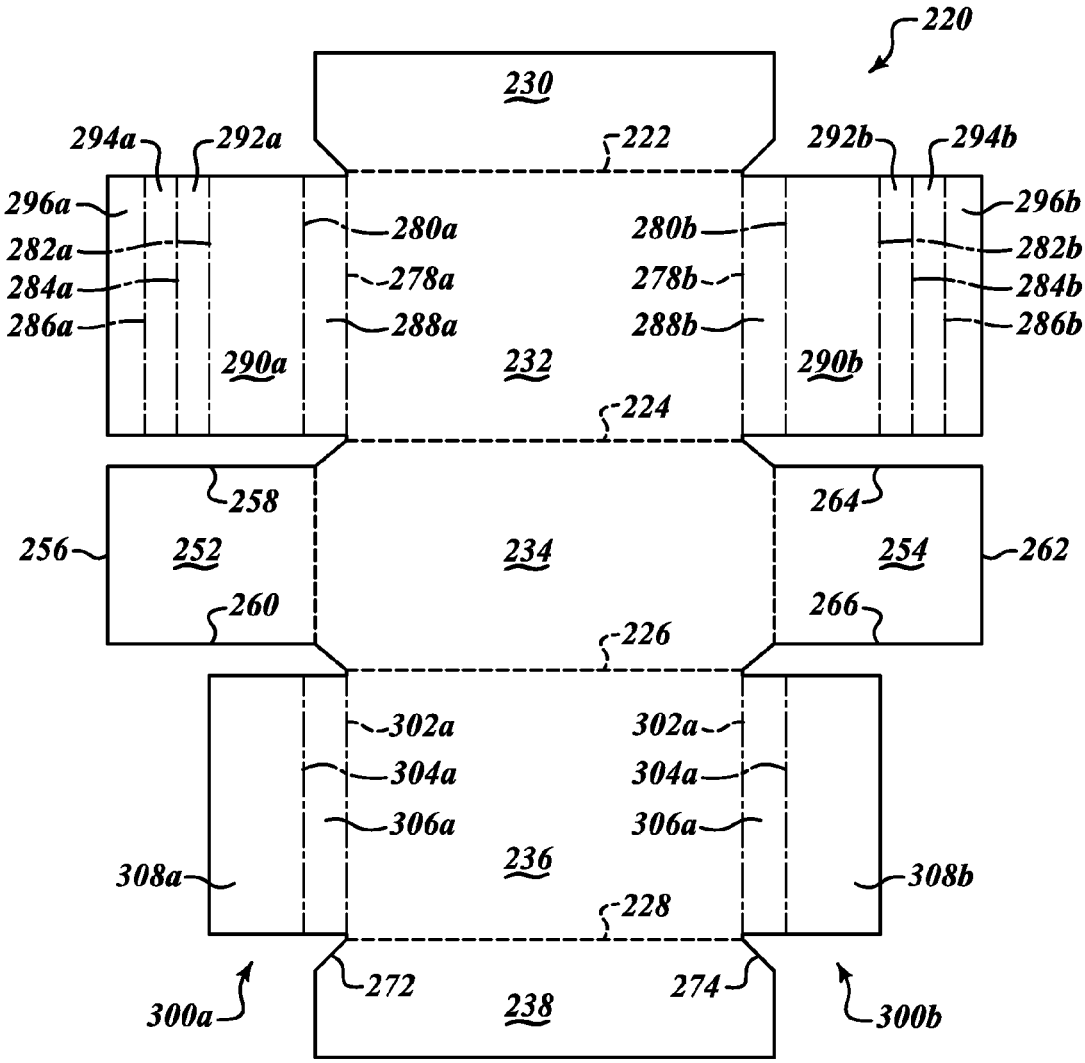
FIG. 10 is a top plan view of another embodiment of a blank for a container that is octagonal in cross-section.
Figure 11:
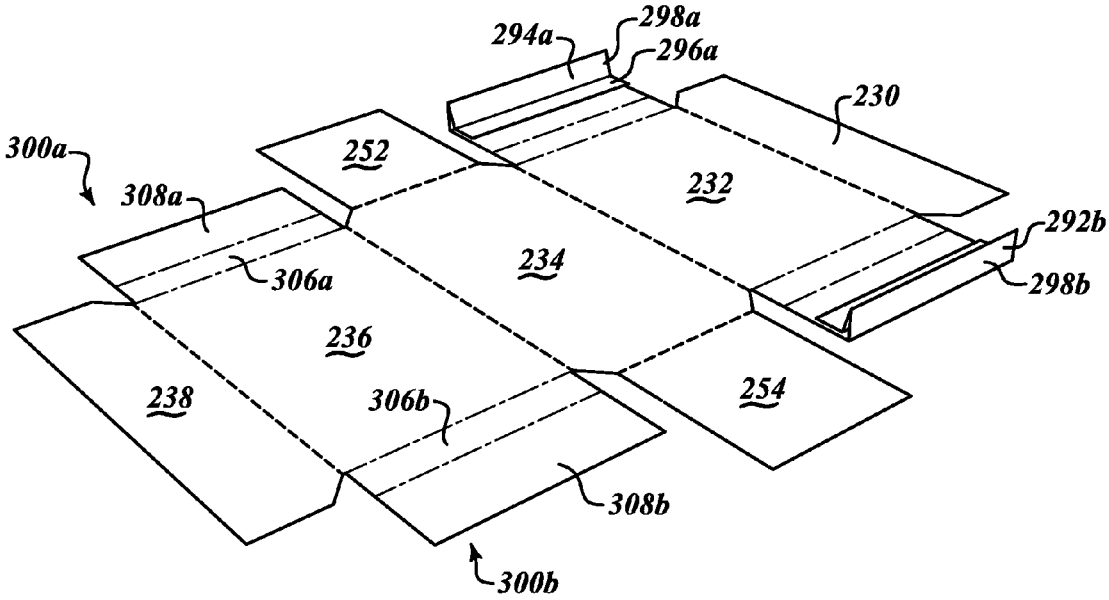
FIGS. 11-16 are isometric views showing the formation of the container of FIG. 9.
Figure 12:
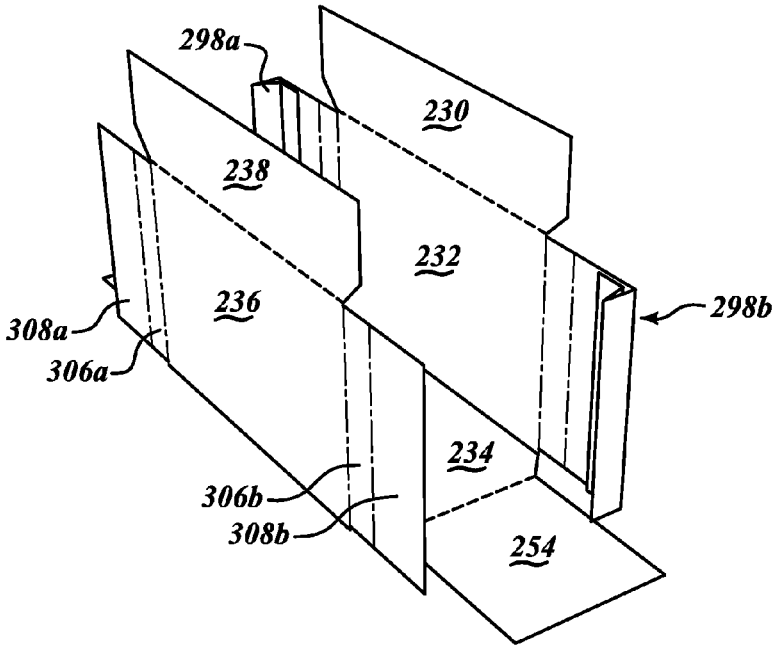
Figure 13:
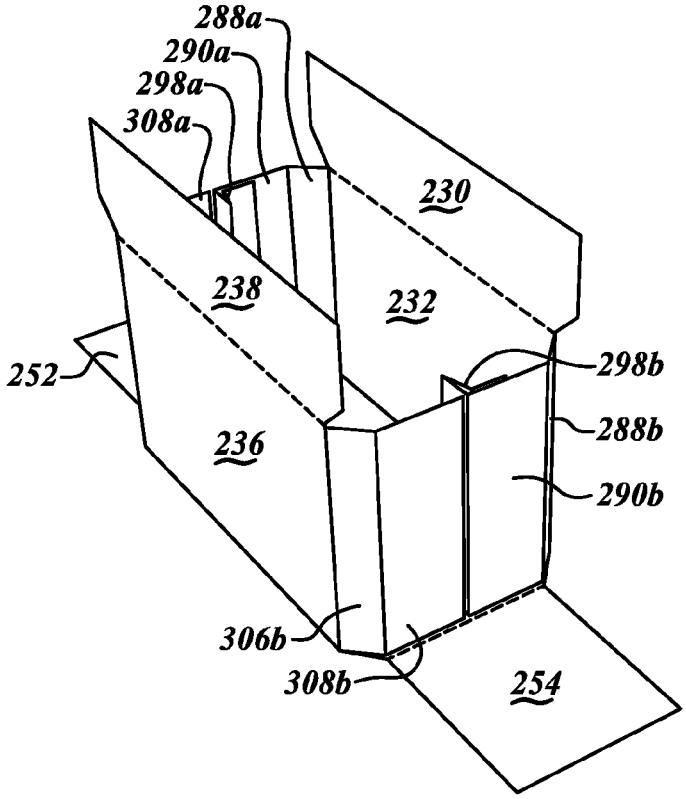
Figure 14:
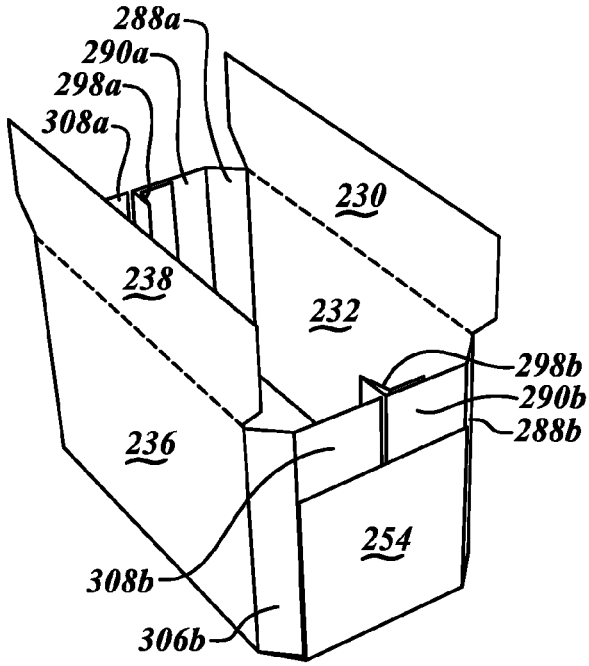
Figure 15:
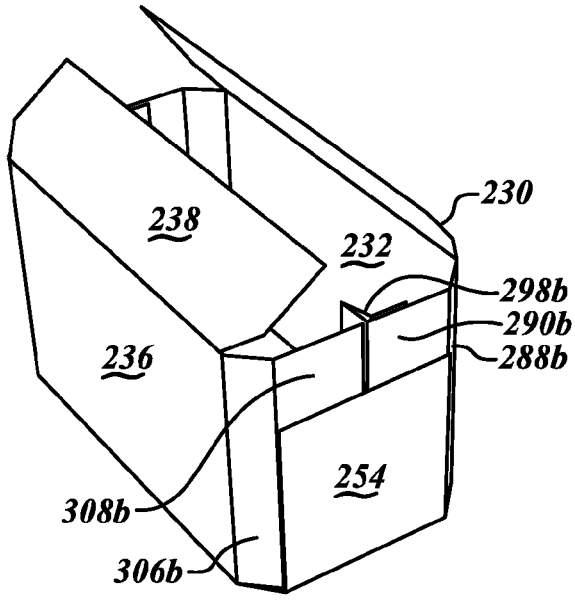
Figure 16:
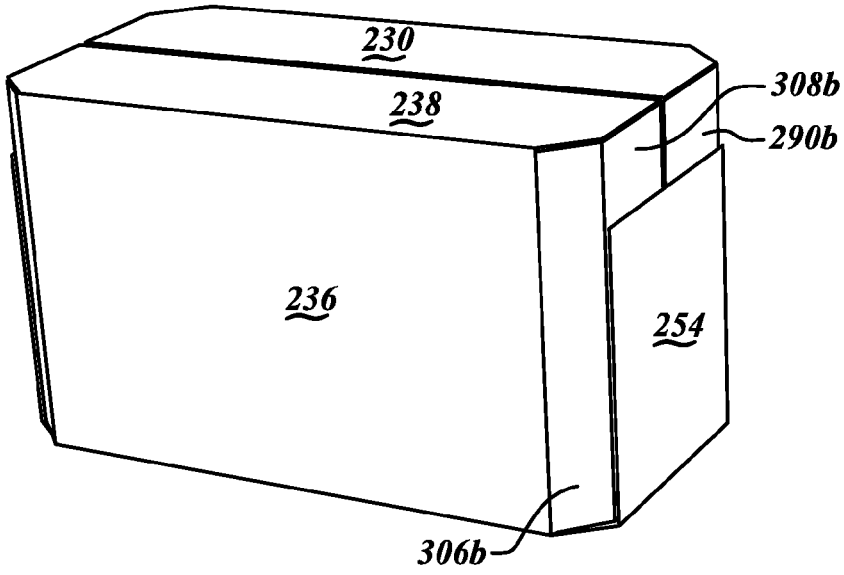

FIG. 10 shows a blank for a container that is octagonal in cross-section. In FIG. 10 the blank 220 is divided by longitudinal parallel attachment lines 222, 224, 226 and 228 into a cover panel 230, a side panel 232, a bottom panel 234, a side panel 236 and a cover panel 238. The bottom panel 234 is octagonal in cross section with sides formed by attachment lines 224 and 226, ends formed by transverse parallel attachment lines 240 and 242 and beveled corners 244, 246, 248 and 250 extending between the attachment lines 224, 240, 226 and 242. The width of each of these corners between the attachment lines is the same.

End panels 252 and 254 are attached to bottom panel 234 along the transverse parallel attachment lines 240 and 242. End panel 252 has an outer edge 256 and side edges 258 and 260. End panel 254 has an outer edge 262 and side edges 264 and 266. The height of each of the end panels 252 and 254 is the distance between its attachment line 240 or 242 and its outer edge 256 or 262. The width of each of the end panels 252 or 254 is the distance between its side edges 258 and 260 or 264 and 266.

Each of the cover panels 230 and 238 is shaped to form a cover that has the same shape as the bottom panel in the formed container. Cover panel 230 has a pair of beveled corners 268 and 270 and cover panel 238 has a pair of beveled corners 272 and 274. The width of each of these corners is the same as the width of the corners in the bottom panel.

The end walls in the formed container are formed by the end panels 252 and 254 and by end members attached to the side panels. There are two pair of end members, The pairs are of different design but each member in each pair has the same design so the same reference numerals will be used for the members in each pair. End members 276*a* and 276*b* are attached to the sides of side panel 232. Each of the end members 276 is attached to the side panel 232 by a transverse attachment line 278. Each of the end members 276 is divided by transverse attachment lines 280, 282, 284 and 286 into corner panel 288, end panel 290, column panel 292, column panel 294 and attachment panel 296. The width of each of the corner panels 288 between attachment lines 278 and 280 is the same as the width of its associated corner 244 or 246. The width of the end panel 290 is the distance between attachment lines 280 and 282.

The columns are formed on the inside face of the end panels 290. The columns are formed by folding attachment panel 296 outwardly around attachment line 286, folding column panel 294 inwardly around attachment line 284 and folding column panel 292 inwardly around attachment line 282. The attachment panel 296 is fastened to end panel 290 by glue or staples. This forms the column 298.

End members 300*a* and 300*b* are attached to the sides of side panel 236. The end members 300*a* and 300*b* are the same and like reference numerals will be used for them. The end members 300*a* and 300*b* are attached to side panel 236 by transverse attachment lines 302. Each of the end members 300*a* and 300*b* is divided by transverse attachment line 304 into a corner panel 306 and an end panel 308. The width of end panel 308 is the distance between attachment line 304 and the outer edge 310 of the end panel 308. The combined width of an end panel 290 and an end panel 308 is the same or less than the width of an end panel 252 or 254.

The container is formed by folding side panels 232 and 236 upwardly until the side panels are perpendicular to the bottom panel 234. The end members 276 are folded inwardly around attachment lines 276 and the end panels 290 are folded inwardly around attachment lines 280. The end members 300 are folded inwardly around attachment lines 302 and the end panels 308 are folded inwardly around attachment lines 304. The corner panels are aligned with their respective corners and the end panels 290 and 308 are aligned with their respective ends and abut. The columns 298 on the inside of the container. The end panels 252 and 254 are folded upwardly around attachment lines 240 and 242. Each of the end panels 252 and 254 is fastened to its associated end panels 290 and 308 by glue or staples.

Figure 17:
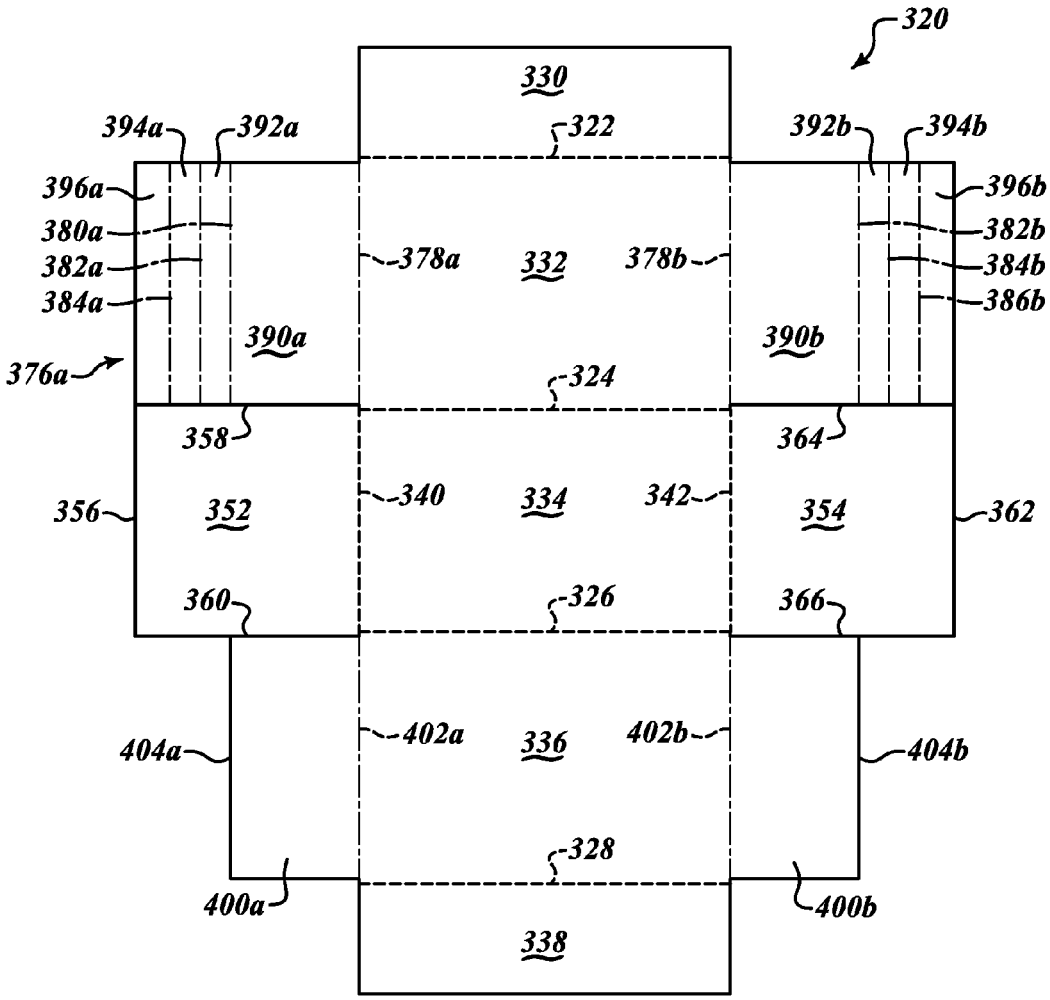
FIG. 17 is a top plan view of another embodiment of a blank for a container that is rectangular in cross-section.

FIG. 17 shows a blank for a container that is rectangular in cross-section. The formation of the this blank into a container is the same as the formation of the octagonal container.

In FIG. 17 the blank 320 is divided by longitudinal parallel attachment lines 322, 324, 326 and 328 into a cover panel 330, a side panel 332, a bottom panel 334, a side panel 336 and a cover panel 338. The bottom panel 334 is rectangular in cross section with sides formed by attachment lines 324 and 326 and ends formed by transverse parallel attachment lines 340 and 342.

End panels 352 and 354 are attached to bottom panel 334 along the transverse parallel attachment lines 340 and 342. End panel 352 has an outer edge 356 and side edges 358 and 360. End panel 354 has an outer edge 362 and side edges 364 and 366. The height of each of the end panels 352 and 354 is the distance between its attachment line 340 or 342 and its outer edge 356 or 362. The width of each of the end panels 352 or 354 is the distance between its side edges 358 and 360 or 364 and 366.

Each of the cover panels 330 and 338 is shaped to form a cover that has the same shape as the bottom panel in the formed container.

The end walls in the formed container are formed by the end panels 352 and 354 and by end members attached to the side panels. There are two pair of end members, The pairs are of different design but each member in each pair has the same design so the same reference numerals will be used for the members in each pair. End members 376*a* and 376*b* are attached to the sides of side panel 332. Each of the end members 376 is attached to the side panel 332 by a transverse attachment line 378. Each of the end members 376 is divided by transverse attachment lines 380, 382 and 384 into end panel 390, column panel 392, column panel 394 and attachment panel 396. The width of the end panel 390 is the distance between attachment lines 378 and 380.

The columns are formed on the inside face of the end panels 390. The columns are formed by folding attachment panel 396 outwardly around attachment line 384, folding column panel 394 inwardly around attachment line 382 and folding column panel 392 inwardly around attachment line 380. The attachment panel 396 is fastened to end panel 390 by glue or staples. This forms the column 398.

End members 400*a* and 400*b* are attached to the sides of side panel 336. The end members 400*a* and 400*b* are the same and like reference numerals will be used for them. The end members 400*a* and 400*b* are attached to side panel 336 by transverse attachment lines 402. The width of end panel 400 is the distance between attachment line 402 and the outer edge

404 opposite the attachment line 402 of the end panel 400. The combined width of an end panel 390 and an end panel 400 is the same or less than the width of an end panel 352 or 354.

Figure 18:
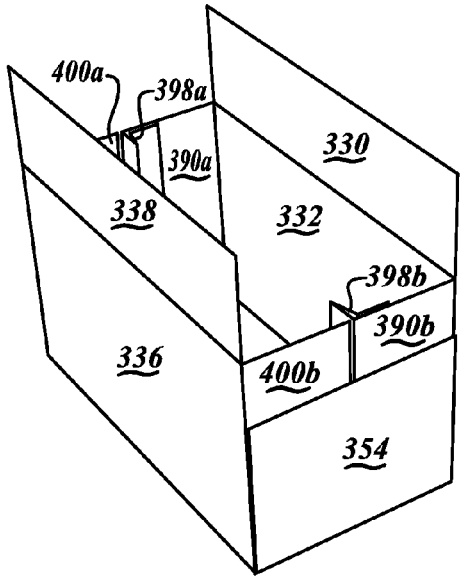
FIG. 18 is an isometric view of the formed rectangular container.

The container is formed by folding end panels 390 inwardly around attachment lines 378. The side panel 232 is folded upwardly around attachment line 224 until the end members 276 rest on the bottom panel 234. The side panel 236 is folded upwardly around attachment line 226 until it is perpendicular to the bottom panel 234. The end panels 308 are folded inwardly around attachment lines 304 and the end members 300 are folded inwardly around attachment lines 302. The corner panels are aligned with their respective corners and the end panels 290 and 308 are aligned with their respective ends and abut. The columns 298 are on the inside of the container. The end panels 252 and 254 are folded upwardly around attachment lines 240 and 242. Each of the end panels 252 and 254 is fastened to its associated end panels 290 and 308 by glue or staples. The widths of the end panels 90 and the heights of the panels 52 and 54 will determine whether the end panels 290 and 308 on each end of the container will be near each other or abut. The container is shown in FIG. 18.

In these last two embodiments, the end members having the corner panels need not be attached to the same side panel.

All of the transverse attachment lines are parallel.

The container may be made of corrugated board, container board or fiber board.

The invention claimed is:

1. A container comprising:

a bottom panel (34);

two end panels (52, 54) each of which foldably attached to the bottom wall; and two side panels (32, 36) foldably attached to the bottom panel (34), each of the side panels (32, 36) includes a respective pair of opposed end members (76*a*, 76*b* and 76*c*, 76*d*) extending from lateral edge thereof wherein each of the respective end member being defined by a plurality of foldably joined panels that upon fully folding to one another form a respective reinforcing triangular column panels wherein two of the reinforcing triangular column panels abut at a center point in the respective end panel (52, 54) of the container which form a double wall reinforcing triangular column panels and wherein the respective reinforcing triangular column panels having a greater height than the respective end panels across the entire width of the respective end panel.

2. The container of claim 1 wherein the plurality of foldably joined panels are defined by respective panels (88*a*, 90*a*, 92*a*, 94*a*, 96*a*), (88*b*, 90*b*, 92*b*, 94*b*, 96*b*), (88*c*, 90*c*, 92*c*, 94*c*, 96*c*), (88*d*, 90*d*, 92*d*, 94*d*, 96*d*).

3. The container of claim 1 further comprising a pair of cover panels each of which is foldably attached to long side of the respective side panels.

* * * * *